US008752655B2

(12) United States Patent
Gallifet

(10) Patent No.: US 8,752,655 B2
(45) Date of Patent: Jun. 17, 2014

(54) ROCK BIT HAVING A LABYRINTH SEAL/BEARING PROTECTION STRUCTURE

(75) Inventor: Thomas Gallifet, Garland, TX (US)

(73) Assignee: Varel International Ind., L.P., Carrollton, TX (US)

( * ) Notice: Subject to any disclaimer, the term of this patent is extended or adjusted under 35 U.S.C. 154(b) by 498 days.

(21) Appl. No.: 13/185,345

(22) Filed: Jul. 18, 2011

(65) Prior Publication Data

US 2013/0020135 A1 Jan. 24, 2013

(51) Int. Cl.
*E21B 10/25* (2006.01)

(52) U.S. Cl.
CPC ..... *E21B 10/25* (2013.01)
USPC ..... 175/371; 384/94

(58) Field of Classification Search
CPC ..... E21B 10/22; E21B 10/25
USPC ..... 175/371–372; 384/93–95
See application file for complete search history.

(56) References Cited

U.S. PATENT DOCUMENTS

| | | | | |
|---|---|---|---|---|
| 3,489,421 | A * | 1/1970 | Neilson | 277/383 |
| 3,656,764 | A | 4/1972 | Robinson | |
| 4,102,419 | A | 7/1978 | Klima | |
| 4,179,003 | A | 12/1979 | Cooper et al. | |
| 4,200,343 | A | 4/1980 | Highsmith | |
| 4,209,890 | A | 7/1980 | Koskie, Jr. | |
| 4,494,749 | A * | 1/1985 | Evans | 277/309 |
| 4,613,004 | A | 9/1986 | Shotwell | |
| 5,005,989 | A | 4/1991 | Karlsson | |
| 5,027,911 | A | 7/1991 | Dysart | |
| 5,224,560 | A | 7/1993 | Fernandez | |
| 5,513,715 | A | 5/1996 | Dysart | |
| 5,570,750 | A | 11/1996 | Williams | |
| 5,740,871 | A | 4/1998 | Williams | |
| 6,254,275 | B1 * | 7/2001 | Slaughter et al. | 384/92 |
| 6,264,367 | B1 | 7/2001 | Slaughter, Jr. et al. | |
| 6,336,512 | B1 * | 1/2002 | Siracki et al. | 175/371 |
| 7,798,248 | B2 | 9/2010 | Stauffer | |
| 2010/0038144 | A1 | 2/2010 | Stauffer | |

FOREIGN PATENT DOCUMENTS

| | | |
|---|---|---|
| SU | 0859588 | 7/1984 |

OTHER PUBLICATIONS

International Search Report and Written Opinion for PCT/US2012/037553 mailed Oct. 11, 2012 (7 pages).

* cited by examiner

*Primary Examiner* — Giovanna Wright
(74) *Attorney, Agent, or Firm* — Gardere Wynne Sewell LLP; Andre M. Szuwalski

(57) ABSTRACT

A drill tool includes a cone mounted for rotation on a bearing shaft that extends from a bit head. The cone has a first planar base surface opposed to a second planar base surface of the bit head. A first annular groove is formed in the first planar base surface, and a second annular groove is formed in the second planar base surface. The first and second annular grooves are at least partially aligned with each other. The combination of the first and second annular grooves form a first annular gland. A protector ring is inserted into the first annular gland, and functions to divide a fluid path between the bearing shaft of the drill tool and an external environment into a plurality of parallel fluid paths that pass around the protector ring. Each parallel fluid path includes a convolution defined by a plurality of fluid direction changing corners.

30 Claims, 8 Drawing Sheets

ROCK BIT HAVING A LABYRINTH SEAL/BEARING PROTECTION STRUCTURE

TECHNICAL FIELD

The present invention relates generally to rock bit drilling tools. The present invention more specifically concerns roller cone drilling tools and protection mechanisms provided with respect to the bearing seal used within such roller cone drilling tools.

BACKGROUND

A roller cone rock bit is a common cutting tool used in oil, gas, and mining fields for breaking through earth formations and shaping well bores. Reference is made to FIG. 1 which illustrates a partially broken away view of a typical roller cone rock bit. FIG. 1 more specifically illustrates one head and cone assembly. The general configuration and operation of such a bit is well known to those skilled in the art.

The head 1 of the bit includes the bearing shaft 2. A cutting cone 3 is rotatably positioned on the bearing shaft 2 which may function as a journal. A body portion 4 of the bit includes an upper portion that is typically threaded for forming a tool joint connection that facilitates connection of the bit to a drill string (not shown). A lubrication system 6 is included to provide lubricant to, and retain lubricant in, the bearing between the cone 3 and the bearing shaft 2. This system 6 has a configuration and operation well known to those skilled in the art.

The bearings used in roller cone rock bits typically employ either rollers as the load carrying element or a journal (as shown in FIG. 1) as the load carrying element. A number of bearing systems are provided in connection with the bearing supporting rotation of the cone 3 about the bearing shaft 2. These bearing systems include a first cylindrical friction bearing 10 (also referred to as the main journal bearing), ball bearings 12, second cylindrical friction bearing 14, first radial friction (thrust) bearing 16 and second radial friction (thrust) bearing 18.

The first cylindrical friction bearing (main journal bearing) 10 of the bearing system is defined by an outer cylindrical surface 20 on the bearing shaft 2 and an inner cylindrical surface 22 of a bushing 24 which has been press fit into the cone 3. This bushing 24 is a ring-shaped structure typically made of beryllium copper, although the use of other materials is known in the art. The ball bearings 12 ride in an annular raceway 26 defined at the interface between the bearing shaft 2 and cone 3. The second cylindrical friction bearing 14 of the bearing system is defined by an outer cylindrical surface 30 on the bearing shaft 2 and an inner cylindrical surface 32 on the cone 3. The outer cylindrical surface 30 is inwardly radially offset from the outer cylindrical surface 20. The first radial friction bearing 16 is defined between the first and second cylindrical friction bearings 10 and 12 by a first radial surface 40 on the bearing shaft 2 and a second radial surface 42 on the cone 3. The second radial friction bearing 18 is adjacent the second cylindrical friction bearing 12 at the axis of rotation for the cone and is defined by a third radial surface 50 on the bearing shaft 2 and a fourth radial surface 52 on the cone 3.

Lubricant is provided in the first cylindrical friction bearing 10, second cylindrical friction bearing 14, first radial friction bearing 16 and second radial friction bearing 18 between the opposed cylindrical and radial surfaces using the system 6. It is critical to retain the lubricant in positions between the opposed surfaces of the bearing system. Retention of the lubricant requires that a sliding seal be formed between the bearing system and the external environment of the bit.

An o-ring seal 60 is positioned in a seal gland 64 between cutter cone 3 and the bearing shaft 2 to retain lubricant and exclude external debris. A cylindrical surface seal boss 62 is provided on the bearing shaft. In the illustrated configuration, this surface of the seal boss 62 is outwardly radially offset (by the thickness of the bushing 24) from the outer cylindrical surface 20 of the first friction bearing 10. It will be understood that the seal boss could exhibit no offset with respect to the main journal bearing surface if desired (see, for example, FIG. 3). The annular seal gland 64 is formed in the cone 3. The gland 64 and seal boss 62 align with each other when the cutting cone 3 is rotatably positioned on the bearing shaft. The o-ring seal 60 is compressed between the surface(s) of the gland 64 and the seal boss 62, with the o-ring seal 60 sliding on the seal boss surface 62 and functioning to retain lubricant in the bearing area around the bearing systems. This seal also assists in preventing materials (drilling mud and debris) in the well bore from entering into the bearing area.

Early seals for rock bits were designed with a metallic Belleville spring clad with an elastomer, usually nitrile rubber (NBR). A significant advancement in rock bit seals came when o-ring type seals were introduced (see, Galle, U.S. Pat. No. 3,397,928, the disclosure of which is hereby incorporated by reference). These o-ring seals were composed of nitrile rubber and were circular in cross section. The seal was fitted into a radial gland formed by cylindrical surfaces between the head and cone bearings, and the annulus formed was smaller than the original dimension as measured as the cross section of the seal. Schumacher (U.S. Pat. No. 3,765,495, the disclosure of which is hereby incorporated by reference) teaches a variation of this seal by elongating the radial dimension which, when compared to the seal disclosed by Galle, required less percentage squeeze to form an effective seal.

Several other minor variations of this sealing concept have been used, each relying on an elastomer seal squeezed radially in a gland formed by cylindrical surfaces between the two bearing elements, and are well known to those skilled in the art. Over time, the rock bit industry has moved from a standard nitrile material for the seal ring, to a highly saturated nitrile elastomer for added stability of properties (thermal resistance, chemical resistance).

The use of a sealing means in rock bit bearings has dramatically increased bearing life in the past fifty years. The longer the seal excludes contamination from the bearing, the longer the life of the bearing and drill bit. The seal is, thus, a critical component of the rock bit. Indeed, the life of the seal is limited by seal wear and damage. The seal 60 is retained in the gland 64 and slides on the bearing shaft (at surface 62) and functions to separate the grease of the bearing from the outside environment (drilling mud, air, cuttings, etc.). The presence of abrasive particles (known as detritus) introduced to the seal from the outside environment tends to accelerate the wear of the seal 60. For instance, if the abrasive particles are of sufficient size (or quantity), the seal 60 can be torn.

To address this issue, it is known to those skilled in the art to create some sort of convolution 80 in the fluid path between the seal gland and the outside environment. This convolution is created by the geometry of the head and cone. FIG. 1 illustrates one example in a sealed bearing of such a convolution 80 created by configuring the geometry of the head and cone to introduce a corner 82 (formed in this case by a right angle) in the fluid path between the seal 60 and the outside environment 84. FIG. 2 illustrates another example of such a convolution 80 in a sealed bearing created by configuring the geometry of the head and cone to introduce two corners 86 and 88 (each formed in this case by an obtuse angle, although right angles or mixed angles could be used) in the fluid path between the seal 60 and the outside environment 84. An additional corner 82 (formed in this case by an obtuse angle, although a right angle could be used, and positioned similarly to the single corner shown in FIG. 1) is also provided in the fluid path. FIG. 3 illustrates another example of such a convolution 80 created by configuring the geometry of the head and cone to introduce two corners 86 and 88 (each formed in this case by an obtuse angle, although right angles or mixed angles could be used) in the fluid path between the seal 60 and the outside environment 84. The included convolution 80 functions to impede the passage of abrasive particles (detritus) from the outside environment 84 towards the seal 60.

Reference is now made to FIG. 4 which shows the use of a labyrinth seal protector 90 in a sealed bearing to introduce the convolution 80 in the fluid path between the seal 60 and the outside environment 84. The labyrinth seal protector 90 is a ring structure having an L-shape (in cross-section). An annular groove 92 is formed in a radial base surface 91 of the cone 3. The annular groove 92 is radially offset from the seal gland by surface 94. The shorter leg of the L-shaped labyrinth seal protector 90 ring is inserted into the annular groove 92, with the longer leg of the L-shaped labyrinth seal protector 90 ring positioned between the cone 3 (surface 91) and the radial base surface 93 of the head 1 adjacent the shaft 2. Reference is made to Shotwell, U.S. Pat. No. 4,613,004, the disclosure of which is hereby incorporated by reference.

Reference is now additionally made to FIG. 5. The labyrinth seal protector 90 divides the fluid path between the seal 60 and the outside environment 84 into a first fluid path 300 extending around the surfaces of the annular groove 92 and surface 94 (passing corners 95, 96, 97 and 98) and a second fluid path 302 extending along the radial base surface 93 of the head 1 adjacent the shaft 2 and the cylindrical surface 62 (passing corner 82). The dotted lines in FIG. 5 generally illustrate the surfaces of the head, shaft and cone adjacent the protector 90 and seal 60. The first and second fluid paths 300 and 302 are parallel to each other with respect to passing around the L-shaped labyrinth seal protector 90 ring. Notwithstanding the introduction of a convolution 80 in the first fluid path 300 requiring passage by four corners (95, 96, 97 and 98), the configuration of FIG. 4 still presents a second fluid path 302 having a convolution 80 with only a single corner (82).

There is a need for an improved labyrinth seal protector structure and configuration which provides for better protection against the passage of abrasive particles (detritus) from the outside environment 84 towards the seal 60.

It is also known in the art to have an open bearing (i.e., a non-sealed bearing which does not use a sealed lubricant) in some applications. The open bearing may comprise either a journal bearing or a roller bearing, or some combination of bearing structures and systems. The issue of excluding contamination from the bearing, so as to prolong bearing life, is also a concern with an open bearing. Thus, there is a need in the art for an improved labyrinth protector structure and configuration which provides for better protection against the passage of abrasive particles (detritus) from the outside environment towards the bearing structure.

Reference is further made to the following prior art references (the disclosures of all references are incorporated herein by reference): U.S. Pat. Nos. 3,656,764, 4,102,419, 4,179,003, 4,200,343, 4,209,890, 4,613,004, 5,005,989, 5,027,911, 5,224,560, 5,513,715, 5,570,750, 5,740,871, 6,254,275, and 7,798,248, and U.S. Patent Application Publication No. 2010/0038144.

SUMMARY

In an embodiment, a drill tool comprises: a bit head having a radially extending base surface; at least one bearing shaft extending from the bit head; a cone mounted for rotation on the bearing shaft and having a radially extending base surface; a first annular groove formed in the radially extending base surface of the cone; a second annular groove formed in the radially extending base surface of the bit head, wherein first annular groove is aligned with at least a portion of the second annular groove; and a protector ring having a size and shape to fit between the cone and bit head positioned within both the first and second annular groove.

In an embodiment, a drill tool comprises: a cone mounted for rotation on a bearing shaft extending from a bit head, the cone having a first radially extending planar base surface opposed to a second radially extending planar base surface of the bit head; a first annular groove formed in the first radially extending planar base surface; a second annular groove formed in the second radially extending planar base surface, wherein the first annular groove is aligned with at least a portion of the second annular groove, the combination of the first and second annular grooves forming a first annular gland; and a protector ring inserted into the first annular gland.

In an embodiment, a drill tool comprises: a cone mounted for rotation on a bearing shaft extending from a bit head, the cone having a first radially extending planar base surface opposed to a second radially extending planar base surface of the bit head; a first annular groove formed in the first radially extending planar base surface, the first annular groove having first and second opposed side walls; a second annular groove formed in the second radially extending planar base surface, the second annular groove having first and second opposed side walls, wherein the first side wall of the first annular groove is radially aligned with the first side wall of the second annular groove, the combination of the first and second annular grooves forming a first annular gland; and a protector ring inserted into the first annular gland.

In an embodiment, a drill tool includes: a cone mounted for rotation on a bearing shaft that extends from a bit head, the cone having a first planar base surface opposed to a second planar base surface of the bit head; a first annular groove formed in the first planar base surface; a second annular groove formed in the second planar base surface, wherein the first and second annular grooves are at least partially aligned with each other, and wherein the combination of the first and second annular grooves form a first annular gland; and a protector ring inserted into the first annular gland which functions to divide a fluid path between the bearing shaft of the drill tool and an external environment into a plurality of parallel fluid paths that pass around the protector ring. Each parallel fluid path includes a convolution defined by a plurality of fluid direction changing corners.

BRIEF DESCRIPTION OF THE DRAWINGS

Reference is now made to the Figures wherein.

DETAILED DESCRIPTION OF THE DRAWINGS

Figure 1:
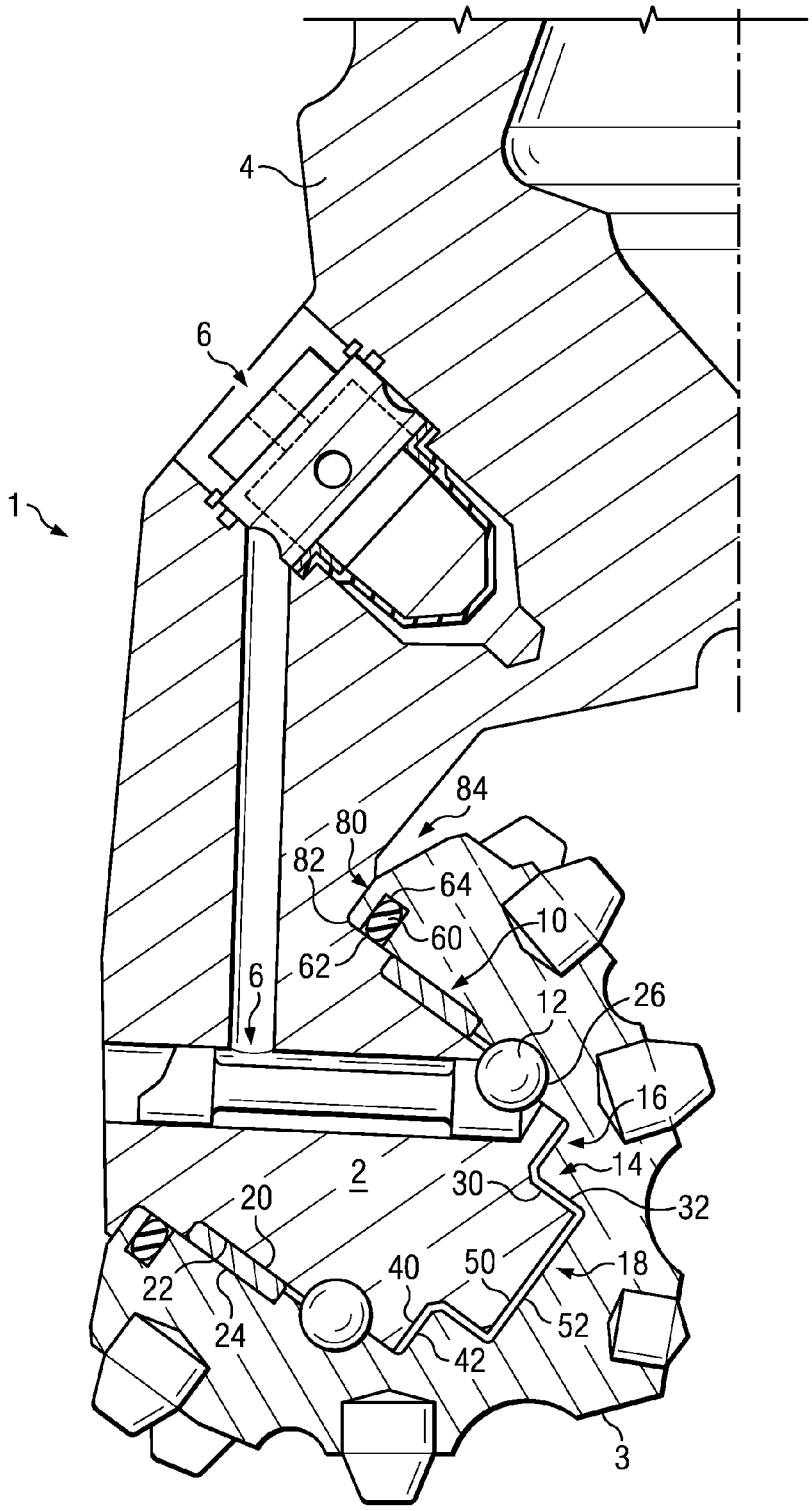
FIG. 1 (PRIOR ART)
FIGS. 1, 2 and 3 each illustrate a partially broken away view of a typical roller cone rock bit showing a prior art convolution structure for seal protection.
Figure 2:
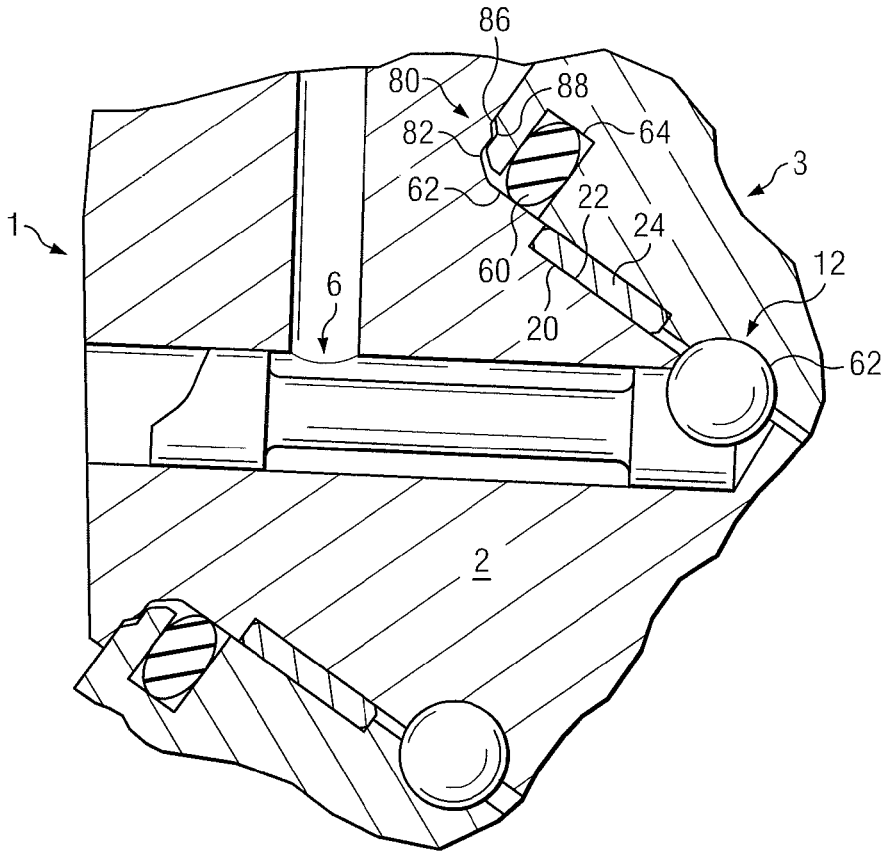
FIG. 2 (PRIOR ART)
Figure 3:
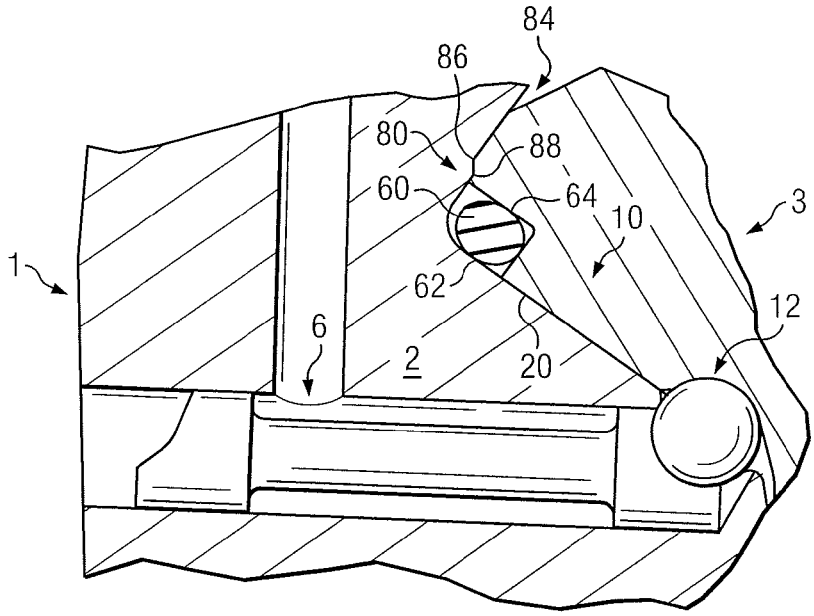
FIG. 3 (PRIOR ART)
Figure 4:
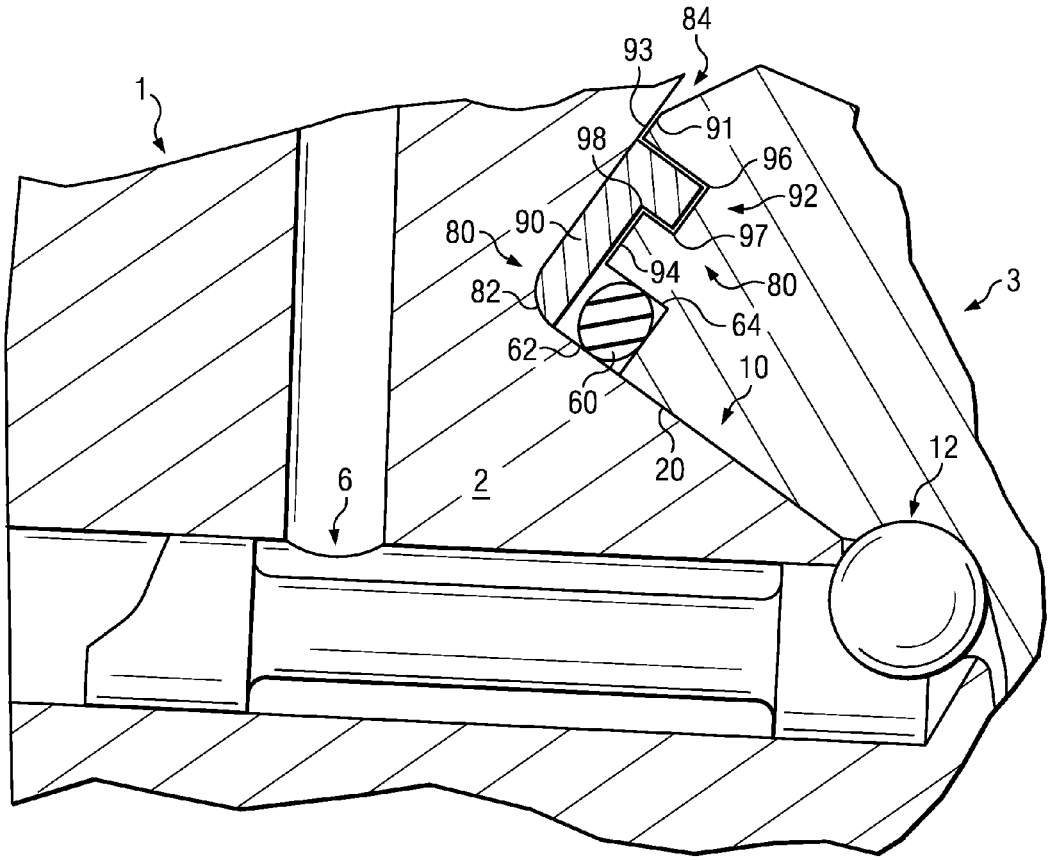
FIG. 4 (PRIOR ART)
FIG. 4 illustrates a partially broken away view of a typical roller cone rock bit showing a prior art labyrinth seal protection structure.
Figure 5:
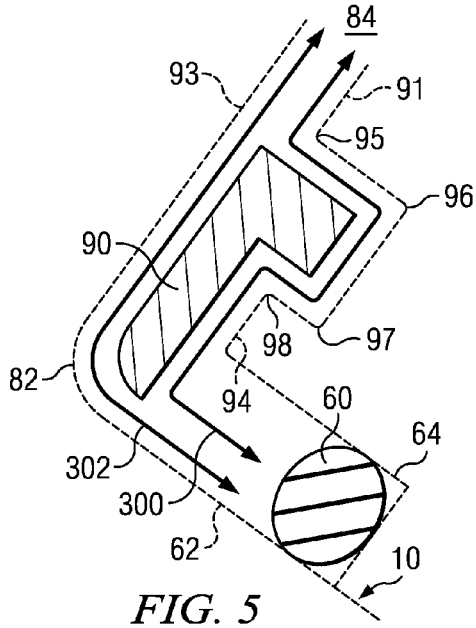
FIG. 5 (PRIOR ART)
FIG. 5 illustrates the divided parallel fluid paths presented by the structure of FIG. 4.
Figure 6:
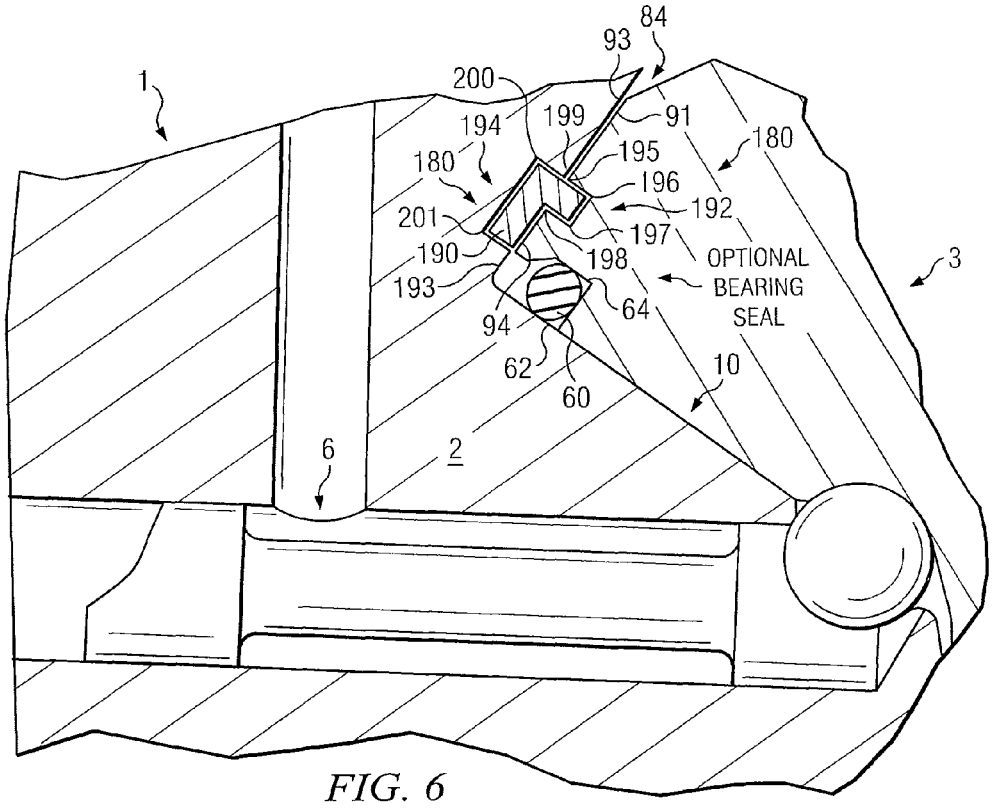
FIG. 6 illustrates a partially broken away view of a roller cone rock bit showing an embodiment of an improved labyrinth seal/bearing protection structure.

Reference is now made to FIG. 6 which illustrates a partially broken away view of a roller cone rock bit showing an embodiment of an improved labyrinth seal/bearing protection structure. Like reference numbers refer to like or similar parts in FIGS. 1-5. The improved labyrinth seal/bearing protection structure in FIG. 6 uses an L-shaped (in cross-section) labyrinth seal/bearing protector 190 ring like the protector 90 ring of FIG. 4. However, a different head and cone geometry is provided to support installation of the labyrinth seal/bearing protector 190 ring and the introduction of an improved convolution 180 in the fluid path between the seal 60 and the outside environment 84. Although illustrated for use with a sealed bearing, which includes seal 60 in gland 64, it will be understood that the labyrinth seal/bearing protector 190 ring is equally useful in an open bearing (with no seal) to introduce an improved convolution 180 in the fluid path between the bearing 10 and the outside environment 84. The presence of the gland 64 and seal 60 in FIG. 6 is provided for illustration only and is optional structure used in the sealed bearing implementation. Although illustrated with a journal bearing, it will be understood that the labyrinth seal/bearing protector 190 ring is useful in protecting any type bearing including journal and roller bearings.

A first annular groove 192 is formed in a radial base surface 91 of the cone 3 (this radial base surface 91 forming a back face of the cone), the groove 192 including opposed side walls and a floor. The first annular groove 192 is radially offset from the seal gland by surface 94 (i.e., surface 94 separates one side wall of the groove 192 from the area of the seal gland 64, if present). The surface 94 may, in one embodiment, comprise a portion of the radial base surface 91 (in other words, the surface 94 and the surface 91 are coplanar). In another embodiment, the surface 94 may comprise a surface defined by the formation of the first annular groove 192 itself (in other words, the surface 94 and the surface 91 are parallel, but not coplanar). The surface 94, in the alternative open bearing embodiment, is an offset separating one side wall of the groove 192 from the cylindrical bearing surface of the shaft 2. A second annular groove 194 is formed in a radial base surface 93 of the head 1 adjacent the shaft 2, this radial base surface 93 being opposed to the radial base surface 91 forming a back face of the cone, the groove 194 including opposed side walls and a floor. The second annular groove 194 is radially offset from the cylindrical seal surface 62 by a portion 193 of the radial base surface 93 (i.e., surface 93 separates one side wall of the groove 194 from the shaft 2 and sealing surface 62). The surface defined by portion 193 is thus, in a preferred implementation, coplanar with the radial base surface 93. Alternatively, the surface defined by portion 193 is produced by the formation of the second annular groove 194 (and is thus parallel to, but not coplanar with, the surface 93). At least a portion of the second annular groove 194 is radially aligned with the first annular groove 192. In a preferred implementation, one side wall of the first annular groove 192 is radially aligned with a corresponding one side wall of the second annular groove 194.

The first and second annular grooves 192 and 194 together define an L-shaped (in cross-section) annular ring gland which receives the L-shaped (in cross-section) labyrinth seal/bearing protector 190 ring. The L-shaped labyrinth seal/bearing protector 190 ring is sized and shaped to conform to the annular ring gland opening, but is not a pressfit member and indeed will have some clearance about its periphery with respect to the annular ring gland. One leg (for example, the shorter leg) of the L-shaped labyrinth seal/bearing protector 190 ring is inserted into the first annular groove 192. Another leg (for example, the longer leg) of the L-shaped labyrinth seal/bearing protector 190 ring inserted into the second annular groove 194. With the described head and cone geometry and placement of the L-shaped labyrinth seal/bearing protector 190 ring, it will be noted that the L-shaped labyrinth seal/bearing protector 190 ring is positioned between the cone 3 and the shaft 2 (so that in the sealed bearing implementation, it is between the outside environment and the seal, and in the open bearing implementation, it is between the outside environment and the bearing).

Figure 7A:
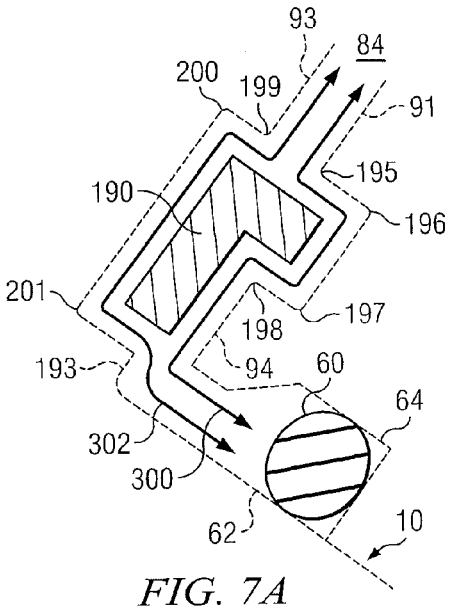
FIG. 7A illustrates the divided parallel fluid paths presented by the structure of FIG. 6.
Figure 7B:
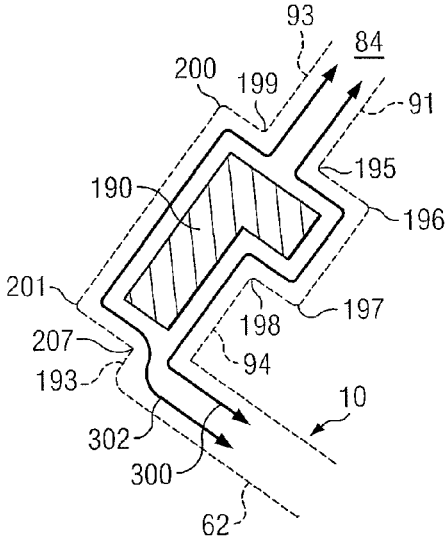
FIG. 7B illustrates the divided parallel fluid paths presented in an alternative implementation.

Reference is now additionally made to FIGS. 7A and 7B, wherein FIG. 7A illustrates the sealed bearing implementation and FIG. 7B illustrates the open bearing implementation. The described head and cone geometry and placement of the L-shaped labyrinth seal/bearing protector 190 ring divides the fluid path between the seal 60 (in FIG. 7A) and/or the bearing 10 (in FIG. 7B) and the outside environment 84 into a first fluid path 300 extending around the surfaces of the first annular groove 192 (passing corners 195, 196, 197 and 198) and a second fluid path 302 extending around surfaces of the second annular groove 194 (passing corners 199, 200 and 201). The dotted lines in FIGS. 7A and 7B generally illustrate the surfaces of the head, shaft and cone adjacent the protector 190 and seal 60/bearing 10. The first and second fluid paths 300 and 302 are parallel to each other with respect to passing around the L-shaped labyrinth seal/bearing protector 190 ring. This configuration thus not only divides the fluid path between the seal 60/bearing 10 and the outside environment 84 into first and second fluid paths 300 and 302 (similar to the labyrinth seal protection of FIGS. 4 and 5), but further provides for each of the first and second fluid paths 300 and 302 to present a convolution 180 comprising at least two (and more preferably, more than two) corners. Indeed, the implementation of FIG. 6 presents a convolution 180 relating to the first fluid path 300 having four corners (195, 196, 197 and 198), which is at least as many as is presented with the first fluid path 300 in FIGS. 4 and 5, and a convolution 180 relating to the second fluid path 302 having at least three corners (199, 200 and 201, with added corner 207 in FIG. 7B), which is substantially more than is presented with the second fluid path 302 in FIGS. 4 and 5.

The fluid paths at each corner preferably change direction at a right angle for the convolution. However, it will be noted that the angle of the convolution could alternatively have an obtuse (and perhaps acute) angular configuration.

Figure 10:
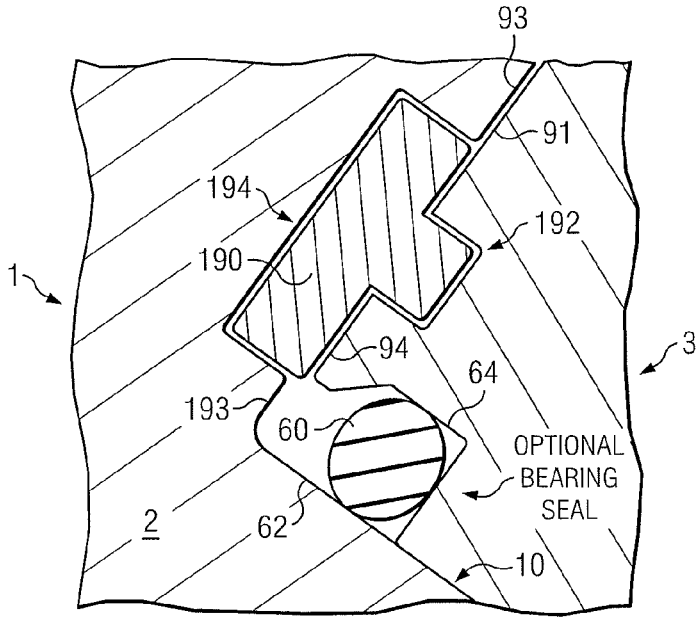
FIGS. 10-12 illustrate alternative shapes for the labyrinth seal/bearing protection structure.
Figure 11:
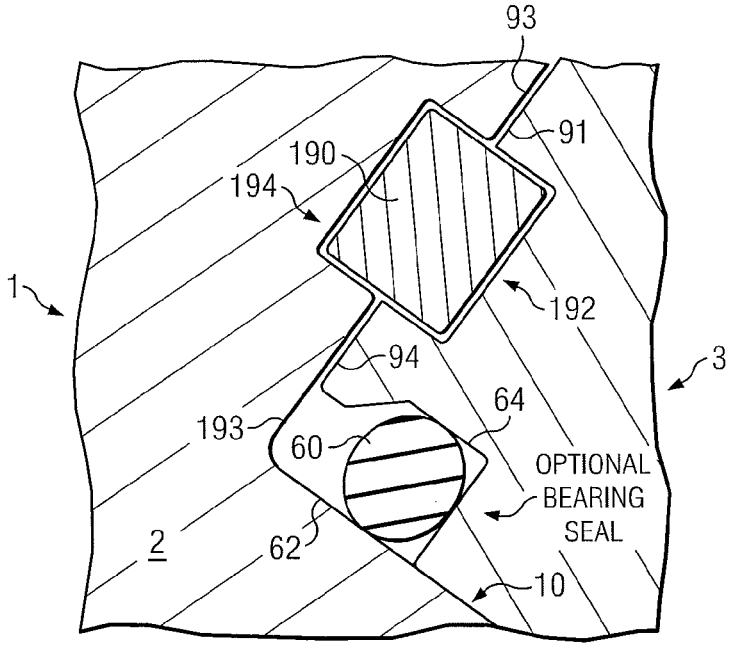

Although an L-shaped, in cross-section, labyrinth seal/bearing protector 190 ring is illustrated as a preferred implementation, it will be recognized that the labyrinth seal/bearing protector 190 ring could have other cross-sectional shapes including a T-shape which would similarly provide for a division of the fluid path into plural parallel paths each with having a convolution including at least two, and more preferably at least three, corners. See, FIG. 10. In another implementation, the labyrinth seal/bearing protector 190 ring could instead have a bar (I-shape) configuration in cross-section which would provide for a division of the fluid path into plural parallel paths each with having a convolution including at least two, and more preferably at least three, corners. See, FIG. 11.

Figure 12:
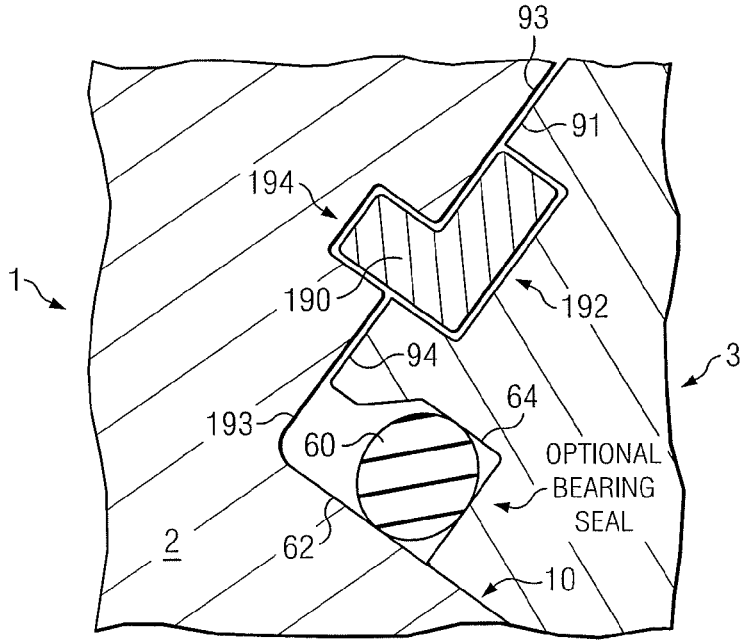

Additionally, where the size and configuration of the drill bit permits, the geometries for the first and second annular grooves could be exchanged with respect the radial base surfaces as is shown in FIG. 12. In this configuration, the short leg of the L-shaped labyrinth seal/bearing protector 190 ring would be inserted into the second annular groove 194 formed in surface 93 while the other long leg of the L-shaped labyrinth seal/bearing protector 190 ring would be inserted into the first annular groove 192 formed in surface 91.

Figure 8:
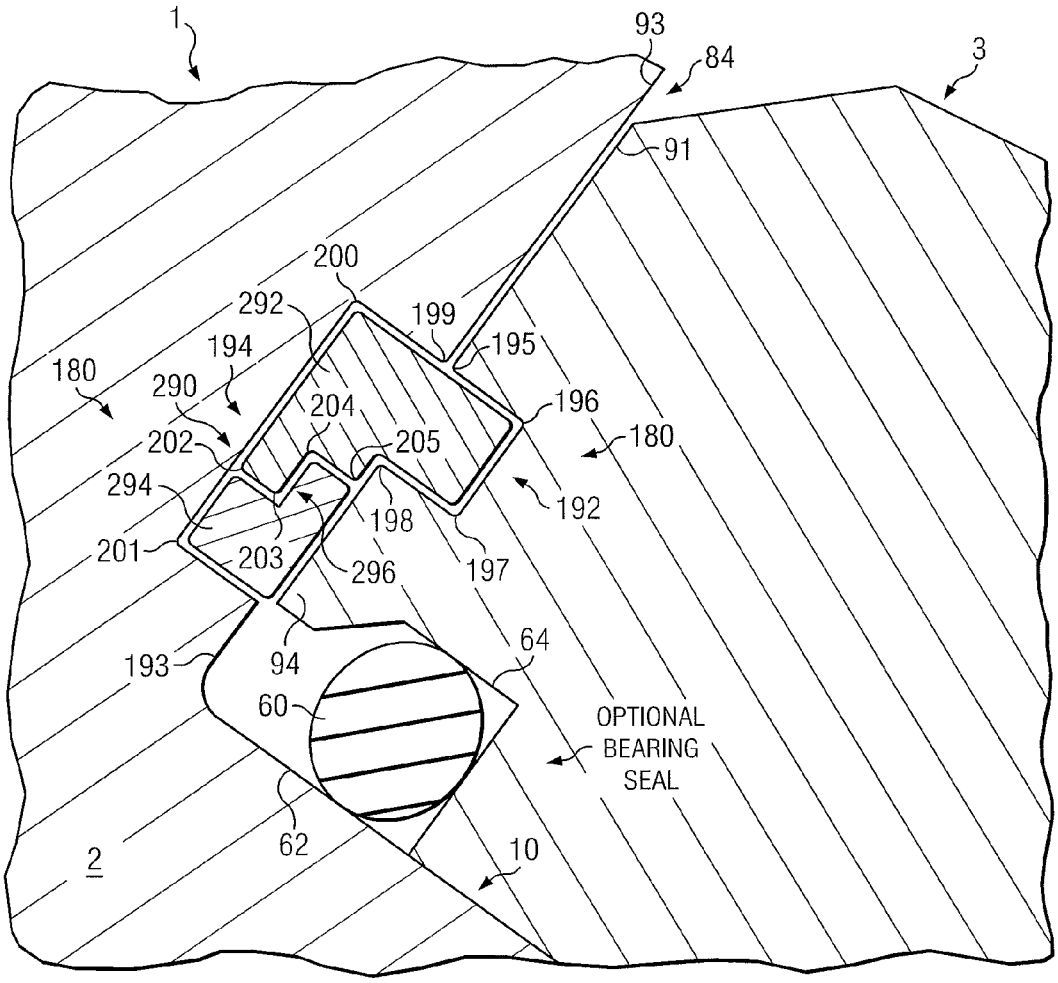
FIG. 8 illustrates a partially broken away view of a roller cone rock bit showing an embodiment of an improved labyrinth seal/bearing protection structure.

Reference is now made to FIG. 8 which illustrates a partially broken away view of a roller cone rock bit showing an embodiment of an improved labyrinth seal/bearing protection structure. Like reference numbers refer to like or similar parts in FIGS. 1-7. The improved labyrinth seal/bearing protection structure in FIG. 8 uses a multi-segment L-shaped (in cross-section) labyrinth seal/bearing protector 290 ring. Again, although illustrated for use with a sealed bearing, which includes seal 60 in gland 64, it will be understood that the labyrinth seal/bearing protector 290 ring is equally useful in an open bearing (with no seal) to introduce an improved convolution 180 in the fluid path between the bearing 10 and the outside environment 84. The presence of the gland 64 and seal 60 in FIG. 8 is provided for illustration only and is optional structure used in the sealed bearing implementation. Although illustrated with a journal bearing, it will be understood that the labyrinth seal/bearing protector 290 ring is useful in protecting any type bearing including journal and roller bearings.

A first annular groove 192 is formed in a radial base surface 91 of the cone 3 (this radial base surface 91 forming a back face of the cone), the groove 192 including opposed side walls and a floor. The first annular groove 192 is radially offset from the seal gland by surface 94 (i.e., surface 94 separates one side wall of the groove 192 from the area of the seal gland 64, if present). The surface 94 may, in one embodiment, comprise a portion of the radial base surface 91 (in other words, the surface 94 and the surface 91 are coplanar). In another embodiment, the surface 94 may comprise a surface defined by the formation of the first annular groove 192 itself (in other words, the surface 94 and the surface 91 are parallel, but not coplanar). The surface 94, in the alternative open bearing embodiment, is an offset separating one side wall of the groove 192 from the cylindrical bearing surface of the shaft 2. A second annular groove 194 is formed in a radial base surface 93 of the head 1 adjacent the shaft 2, this radial base surface 93 being opposed to the radial base surface 91 forming a back face of the cone, the groove 194 including opposed side walls and a floor. The second annular groove 194 is radially offset from the cylindrical seal surface 62 by a portion 193 of the radial base surface 93 (i.e., surface 93 separates one side wall of the groove 194 from the shaft 2 and sealing surface 62). The surface defined by portion 193 is thus, in a preferred implementation, coplanar with the radial base surface 93. Alternatively, the surface defined by portion 193 is produced by the formation of the second annular groove 194 (and is thus parallel to, but not coplanar with, the surface 93). At least a portion of the second annular groove 194 is radially aligned with the first annular groove 192. In a preferred implementation, one side wall of the first annular groove 192 is radially aligned with a corresponding one side wall of the second annular groove 194.

The first and second annular grooves 192 and 194 together define an L-shaped (in cross-section) annular ring gland which receives the multi-segment L-shaped (in cross-section) labyrinth seal/bearing protector 290 ring. The multi-segment L-shaped labyrinth seal/bearing protector 290 ring is sized and shaped to conform to the annular ring gland opening, but is not a pressfit member and indeed will have some clearance about its periphery with respect to the annular ring gland. The multi-segment labyrinth seal/bearing protector 290 ring includes a first segment 292 ring and a second segment 294 ring. The first segment 292 ring and second segment 294 ring interface with each other at a complementary interface surface 296 (in this example, the interface surface 296 has a Z-shape (in cross-section)). Combined together, the first segment 292 ring and second segment 294 ring define the L-shape (in cross-section) of the labyrinth seal/bearing protector 290 ring. One leg (for example, the shorter leg) of the multi-segment L-shaped labyrinth seal/bearing protector 290 ring is inserted into the first annular groove 192. Another leg (for example, the longer leg) of the multi-segment L-shaped labyrinth seal/bearing protector 290 ring is inserted into the second annular groove 194. The interface surface 296 is provided within said another (longer) leg of the multi-segment L-shaped labyrinth seal/bearing protector 290 ring (although it could alternatively be provided within the other (shorter) leg. With the described head and cone geometry and placement of the multi-segment L-shaped labyrinth seal/bearing protector 290 ring, it will be noted that the multi-segment L-shaped labyrinth seal/bearing protector 290 ring is positioned between the cone 3 and the shaft 2 (so that in the sealed bearing implementation, it is between the outside environment and the seal, and in the open bearing implementation, it is between the outside environment and the bearing).

Figure 9A:
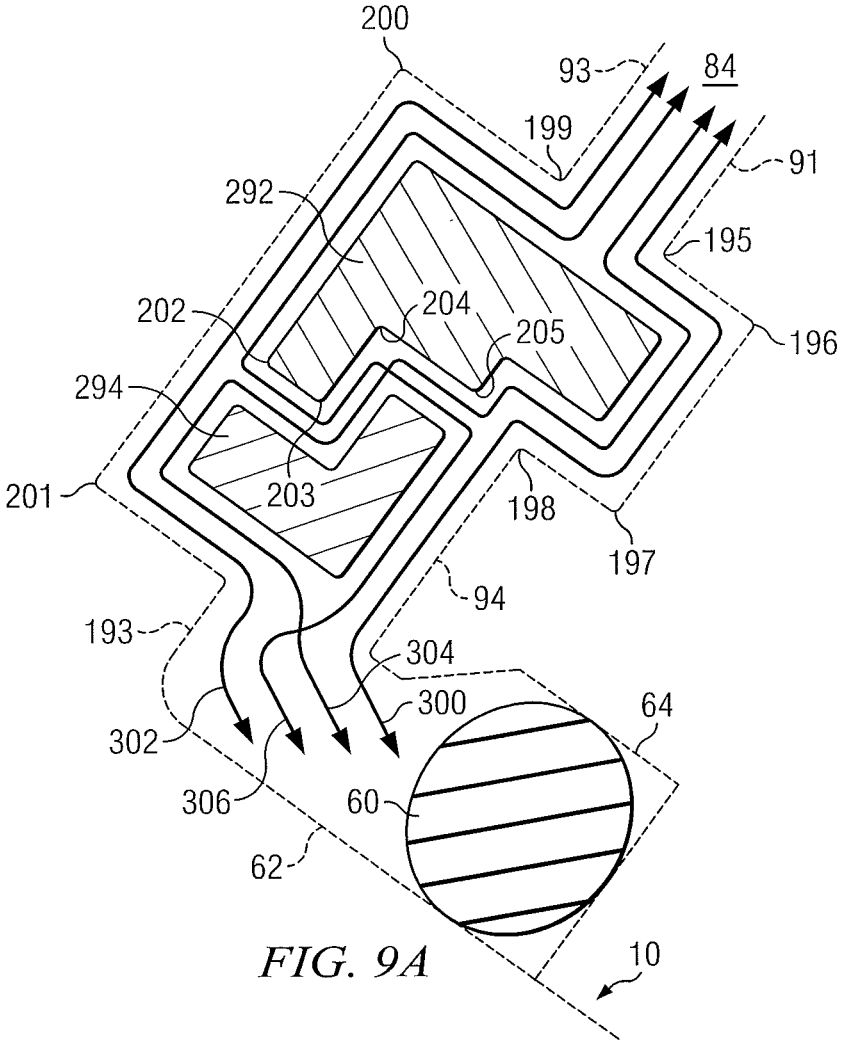
FIG. 9A illustrates the divided parallel fluid paths presented by the structure of FIG. 8.
Figure 9B:
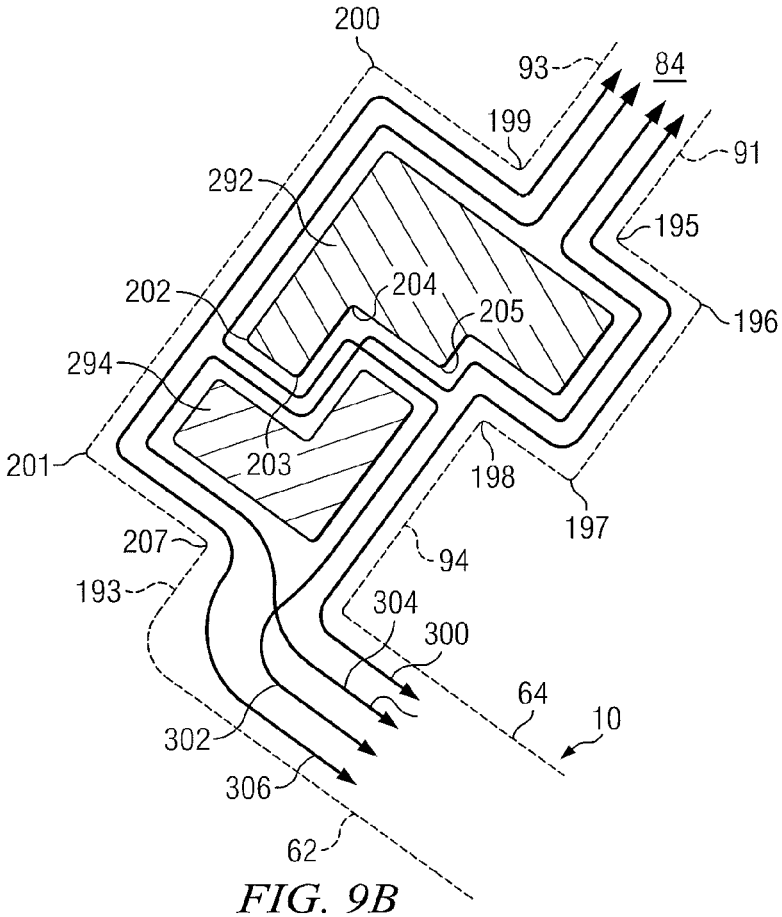
FIG. 9B illustrates the divided parallel fluid paths presented in an alternative implementation.

Reference is now additionally made to FIGS. 9A and 9B, wherein FIG. 9A illustrates the sealed bearing implementation and FIG. 9B illustrates the open bearing implementation. The described head and cone geometry and placement of the multi-segment L-shaped labyrinth seal/bearing protector 290 ring divides the fluid path between the seal 60 (in FIG. 9A) and/or the bearing 10 (in FIG. 9B) and the outside environment 84 into a plurality of fluid paths. The dotted lines in FIGS. 9A and 9B generally illustrate the surfaces of the head, shaft and cone adjacent the protector 290 and seal 60/bearing 10. A first fluid path 300 extends around the surfaces of the first annular groove 192 (passing corners 195, 196, 197 and 198). A second fluid path 302 extends around surfaces of the second annular groove 194 (passing corners 199, 200 and 201, and corner 207 in FIG. 9B). A third fluid path 304 extends around a portion of the first annular groove 192 (passing corners 195, 196, 197 and 198), passes through the interface surface 296 (passing corners 205, 204, 203, and 202), and extends around a portion of the second annular groove 194 (passing corner 201). A fourth fluid path 306 extends around a portion of the second annular groove 194 (passing corners 199 and 200), passes through the interface surface 296 (passing corners 202, 203, 204, and 205), and extends around a portion of the first annular groove 194 (associated with surface 94). The first, second, third and fourth fluid paths 300, 302, 304 and 306 are parallel to each other with respect to passing around (and through) the multi-segment L-shaped labyrinth seal/bearing protector 290 ring.

This configuration thus not only divides the fluid path between the seal 60 and the outside environment 84 into multiple fluid paths (similar to the labyrinth seal/bearing protection of FIG. 6), but further provides for each of the first, second, third and fourth fluid paths 300, 302, 304 and 306 to present a convolution 180 comprising at least two (and more preferably, more than two) corners. Indeed, the implementation of FIG. 8 presents a convolution 180 relating to the first fluid path 300 having four corners (195, 196, 197 and 198), a convolution 180 relating to the second fluid path 302 having at least three corners (199, 200 and 201, with a fourth corner 207 in FIG. 9B), a convolution 180 relating to the third fluid path 304 having at least nine corners (195, 196, 197, 198, 205, 204, 203, 202 and 201, with an additional corner 207 in FIG. 9B), and a convolution 180 relating to the fourth fluid path 306 having six corners (199, 200, 202, 203, 204 and 205).

The fluid paths at each corner preferably change direction at a right angle for the convolution. However, it will be noted that the angle of the convolution could alternatively have an obtuse (and perhaps acute) angular configuration.

Although the multi-segment L-shaped labyrinth seal/bearing protector 290 ring shown in FIG. 8 includes two segments 292 and 294, it will be understood that the multi-segment L-shaped labyrinth seal/bearing protector 290 could alternatively be configured with more than two segments. The use of multiple segments can serve to increase the division of the fluid path between the seal 60 and the outside environment 84 into a plurality of fluid paths, and further provide for additional convolutions.

Although an L-shaped, in cross-section, labyrinth seal/bearing protector 290 ring is illustrated as a preferred implementation, it will be recognized that the multi-segment labyrinth seal/bearing protector 290 ring could have other cross-sectional shapes including a T-shape which would similarly provide for a division of the fluid path into plural parallel paths each with having a convolution including at least two, and more preferably at least three, corners. In another implementation, the multi-segment labyrinth seal/bearing protector 290 ring could instead have a bar (I-shape) configuration in cross-section which would provide for a division of the fluid path into plural parallel paths each with having a convolution including at least two, and more preferably at least three, corners.

Additionally, where the size and configuration of the drill bit permits, the geometries for the first and second annular grooves could be exchanged with respect the radial base surfaces (compare to FIG. 12). In this configuration, the short leg of the L-shaped labyrinth seal/bearing protector 290 ring would be inserted into the second annular groove 194 formed in surface 93 while the other long leg of the L-shaped labyrinth seal/bearing protector 290 ring would be inserted into the first annular groove 192 formed in surface 91.

The L-shaped labyrinth seal/bearing protector ring (reference 190 or 290 above) is preferably made of stainless steel, so as to provide for corrosion resistance, with a hardness comparable to material used to form the head and/or cone, so as to provide for wear resistance.

Embodiments of the invention have been described and illustrated above. The invention is not limited to the disclosed embodiments.

What is claimed is:

1. A drill tool, comprising:

a bit head having a radially extending base surface;

at least one bearing shaft extending from the bit head and having a bearing surface;

a cone mounted for rotation on the bearing shaft and having a radially extending base surface;

a first annular groove formed in the radially extending base surface of the cone;

a second annular groove formed in the radially extending base surface of the bit head, wherein first annular groove is aligned with at least a portion of the second annular groove; and a protector ring having a size and shape to fit between the cone and bit head positioned within both the first and second annular groove;

wherein the protector ring, when installed in the first and second annular grooves, divides a fluid path between the bearing shaft and an environment outside said drill tool into a plurality of parallel fluid paths passing at least around the protector ring.

2. The drill tool of claim 1, wherein the shaft further includes a sealing surface, the drill tool further comprising:

a seal gland formed between the cone and the bearing shaft; and a seal member disposed within the seal gland.

3. The drill tool of claim 1 wherein the protector ring has a generally I-shape in cross-section.

4. The drill tool of claim 1 wherein the protector ring has a generally T-shape in cross-section.

5. The drill tool of claim 1 wherein the protector ring has a generally L-shape in cross-section.

6. The drill tool of claim 1 wherein each one of the plurality of parallel fluid paths is presented with a convolution comprising at least two corners defined by the combination of the protector ring and at least one of the first and second annular grooves.

7. The drill tool of claim 1 wherein each one of the plurality of parallel fluid paths is presented with a convolution comprising at least three corners defined by the combination of the protector ring and at least one of the first and second annular grooves.

8. The drill tool of claim 1 wherein a first one of the plurality of parallel fluid paths is presented with a convolution comprising at least three corners defined by the combination of the protector ring and at least one of the first and second annular grooves and all remaining ones of the plurality of parallel fluid paths are presented with a convolution comprising at least four corners defined by the combination of the protector ring and at least one of the first and second annular grooves.

9. The drill tool of claim 1 wherein the protector ring comprises a first ring segment and a second ring segment; further including an interface surface between the first and second ring segments; and wherein the protector ring, when installed in the first and second annular grooves, divides a fluid path between the bearing shaft and an environment outside said drill tool into a plurality of parallel fluid paths passing both around the protector ring and between the first and second ring segments.

10. The drill tool of claim 9 wherein each one of the plurality of parallel fluid paths is presented with a convolution comprising at least two corners defined by the combination of both of the first and second segments of the protector ring and at least one of the first and second annular grooves.

11. The drill tool of claim 9 wherein each one of the plurality of parallel fluid paths is presented with a convolution comprising at least three corners defined by the combination of both of the first and second segments of the protector ring and at least one of the first and second annular grooves.

12. The drill tool of claim 9 wherein a first one of the plurality of parallel fluid paths is presented with a convolution comprising at least three corners defined by the combination of both of the first and second segments of the protector ring and at least one of the first and second annular grooves and all remaining ones of the plurality of parallel fluid paths are presented with a convolution comprising at least four corners defined by the combination of both of the first and second segments of the protector ring and at least one of the first and second annular grooves.

13. The drill tool of claim 12 wherein at least one of the remaining ones of the plurality of fluid paths passes through the interface surface between the first and second ring segments.

14. The drill tool of claim 1 wherein each one of the plurality of parallel fluid paths is presented with a convolution comprising a plurality of corners defined by the shape of the protector ring and an annular gland formed by the first and second annular grooves.

15. The drill tool of claim 14 wherein the fluid path changes direction at each corner at a right angle.

16. The drill tool of claim 1 wherein the second annular groove formed in the radially extending base surface of the bit head is offset from the bearing shaft by a portion of the radially extending base surface of the bit head.

17. The drill tool of claim 1 wherein the first annular groove formed in the radially extending base surface of the cone is offset from the bearing shaft by a portion of the radially extending base surface of the cone.

18. The drill tool of claim 1 wherein the bearing shaft supports a journal bearing for cone rotation.

19. A drill tool, comprising:

a bit head having a radially extending base surface; at least one bearing shaft extending from the bit head and having a bearing surface;

a cone mounted for rotation on the bearing shaft and having a radially extending base surface;

a first annular groove formed in the radially extending base surface of the cone;

a second annular groove formed in the radially extending base surface of the bit head, wherein the first annular groove is aligned with at least a portion of the second annular groove; and a protector ring having a size and shape to fit between the cone and bit head positioned within both the first and second annular groove, the protector ring configured to divide a fluid path between the bearing shaft and an environment outside said drill tool into a plurality of fluid paths passing at least around the protector ring.

20. The drill tool of claim 19, wherein the protector ring has a generally L-shape in cross-section; and wherein the L-shaped in cross-section protector ring has a first leg extending into the first annular groove and a second leg positioned between the cone and bit head within the second annular groove and wherein the L-shaped in cross-section protector ring comprises a first ring segment defining at least a portion of the first leg and a second ring segment defining at least a portion of the second leg.

21. The drill tool of claim 20 further including an interface surface between the first and second ring segments.

22. The drill tool of claim 21 wherein the interface surface has a Z-shape in cross-section.

23. A drill tool, comprising:

a cone mounted for rotation on a bearing shaft extending from a bit head, the cone having a first radially extending planar base surface opposed to a second radially extending planar base surface of the bit head;

a first annular groove formed in the first radially extending planar base surface;

a second annular groove formed in the second radially extending planar base surface, wherein first annular groove is aligned with at least a portion of the second annular groove, the combination of the first and second annular grooves forming a first annular gland; and a protector ring inserted into the first annular gland;

wherein the protector ring, when installed in the first annular gland, divides a fluid path between the bearing shaft and an environment outside said drill tool into a plurality of parallel fluid paths passing around the protector ring.

24. The drill tool of claim 23 further comprising a sliding sealing system provided between the cone and the bearing shaft.

25. The drill tool of claim 24 wherein the sliding sealing system comprises a second annular gland formed between the cone and the bearing shaft and an o-ring sealing member retained within the second annular gland.

26. The drill tool of claim 23 wherein the first annular gland has an L-shape in cross-section and the protector ring has a corresponding L-shape in cross-section.

27. The drill tool of claim 23 wherein each one of the plurality of parallel fluid paths is presented with a convolution comprising at least two corners defined by the shape of the protector ring and the first annular gland.

28. The drill tool of claim 23 wherein each one of the plurality of parallel fluid paths is presented with a convolution comprising at least three corners defined by the shape of the protector ring and the first annular gland.

29. The drill tool of claim 23 wherein each one of the plurality of parallel fluid paths is presented with a convolution comprising a plurality of corners defined by the shape of the protector ring and an annular gland formed by the first and second annular grooves, and wherein the fluid path changes direction at each corner at a right angle.

30. A drill tool comprising:

a cone mounted for rotation on a bearing shaft extending from a bit head, the cone having a first radially extending planar base surface opposed to a second radially extending planar base surface of the bit head;

a first annular groove formed in the first radially extending planar base surface;

a second annular groove formed in the second radially extending planar base surface, wherein first annular groove is aligned with at least a portion of the second annular groove, the combination of the first and second annular grooves forming a first annular gland; and a protector ring inserted into the first annular gland;

wherein the protector ring comprises a first ring segment and a second ring segment and further includes an interface surface between the first and second ring segments.

* * * * *